US011289294B2

(12) United States Patent
Nojima et al.

(10) Patent No.: US 11,289,294 B2
(45) Date of Patent: Mar. 29, 2022

(54) ROTARY SWITCH AND CIRCUIT INTERRUPTER INCLUDING THE SAME

(71) Applicant: EATON INTELLIGENT POWER LIMITED, Dublin (IE)

(72) Inventors: Geraldo Nojima, Arden, NC (US); Steven Chen, Moon Township, PA (US); Robert P. Griffin, Bradford Woods, PA (US); Koustubh D. Ashtekar, Moon Township, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 188 days.

(21) Appl. No.: 16/507,679

(22) Filed: Jul. 10, 2019

(65) Prior Publication Data

US 2021/0012992 A1 Jan. 14, 2021

(51) Int. Cl.

| | |
|---|---|
| ***H01H 50/24*** | (2006.01) |
| ***H01H 50/40*** | (2006.01) |
| ***H01H 50/42*** | (2006.01) |
| ***H01H 51/01*** | (2006.01) |
| ***H01H 50/02*** | (2006.01) |
| ***H01H 71/32*** | (2006.01) |
| ***H01H 71/12*** | (2006.01) |
| ***H01H 51/27*** | (2006.01) |

(52) U.S. Cl.

CPC ..... *H01H 50/24* (2013.01); *H01H 50/023* (2013.01); *H01H 50/40* (2013.01); *H01H 50/42* (2013.01); *H01H 51/01* (2013.01); *H01H 51/27* (2013.01); *H01H 71/123* (2013.01); *H01H 71/323* (2013.01); *H01H 71/326* (2013.01); *H01H 2071/124* (2013.01)

(58) Field of Classification Search

CPC ..... H01H 1/2041–1/2058; H01H 2071/124

See application file for complete search history.

(56) References Cited

U.S. PATENT DOCUMENTS

| | | | | |
|---|---|---|---|---|
| 3,194,918 | A * | 7/1965 | Muscante | H01H 1/18 335/128 |
| 4,272,661 | A | 6/1981 | Dethlefsen | |
| 6,175,288 | B1 * | 1/2001 | Castonguay | H01H 71/2472 218/22 |
| 9,911,562 | B2 | 3/2018 | Bissal et al. | |
| 2014/0126098 | A1 * | 5/2014 | Sarrus | H01H 33/596 361/91.5 |
| 2015/0332880 | A1 | 11/2015 | Falkingham | |

* cited by examiner

*Primary Examiner* — Ramon M Barrera

(74) *Attorney, Agent, or Firm* — Eckert Seamans Cherin & Mellott, LLC

(57) ABSTRACT

A rotary switch includes a housing having an interior and an exterior, a plurality of moving contacts entirely disposed within the interior of the housing, a plurality of stationary contacts disposed partially within the interior of the housing and extending to an exterior of the housing, and a rotary element coupled to the plurality of moving contacts and being structured to rotate between a closed state where at least one of the plurality moving contacts contact a corresponding one of the plurality of stationary contacts and an open state where the plurality of moving contacts and the plurality of stationary contacts are separated.

20 Claims, 8 Drawing Sheets

ROTARY SWITCH AND CIRCUIT INTERRUPTER INCLUDING THE SAME

BACKGROUND

Field

The disclosed concept relates generally to switches, and in particular, to switches in circuit interrupters.

Background Information

Circuit interrupters, such as for example and without limitation, circuit breakers, are typically used to protect electrical circuitry from damage due to an overcurrent condition, such as an overload condition, a short circuit, or another fault condition, such as an arc fault or a ground fault. Circuit interrupters typically include separable contacts for making and breaking the circuit. The separable contacts may be closed rapidly on an operator's response. The separable contacts may be operated either manually by way of an operator handle or automatically in response to a detected fault condition. Typically, such circuit interrupters include an operating mechanism, which is designed to rapidly close or open the separable contacts, and a trip mechanism, such as a trip unit, which senses a number of fault conditions to trip the separable contacts open automatically. Upon sensing a fault condition, the trip unit trips the operating mechanism to a trip state, which moves the separable contacts to their open position.

Some circuit interrupters such as, for example, power circuit breakers, employ vacuum interrupters as the switching devices. Vacuum interrupters generally include separable electrical contacts disposed on the ends of corresponding electrodes within an insulating housing that forms the vacuum chamber. Typically, one of the contacts is fixed relative to both the housing and to an external electrical conductor, which is electrically interconnected with a power circuit associated with the vacuum interrupter. The other contact is part of a movable contact assembly including an electrode stem of circular cross-section and a contact disposed on one end of the electrode stem and enclosed within a vacuum chamber. A driving mechanism is disposed on the other end, external to the vacuum chamber.

Circuit breakers that utilize vacuum interrupters can be quite large. The size makes such devices unwieldy. Additionally, it is desirable to reduce the size of circuit interrupters as there is a premium for space requirements in electrical switchgear.

Some attempts at miniaturizing circuit breakers that employ vacuum interrupters have been made. One example of such a circuit breaker is the indoor switching module type LD manufactured by Tavrida Electric. This type of circuit breaker includes three vacuum interrupters mounted above a frame that includes magnetic actuators. The magnetic actuators drive solenoids that linearly move a drive insulator to pull apart or push together contacts within the vacuum interrupters. However, the total size of the circuit breaker has a height of 18-21 inches, a width of 17-27 inches, and a depth of 6-7 inches for a 3-pole circuit breaker.

Some other examples of vacuum interrupters are described in U.S. Pat. Nos. 4,272,661 and 9,911,562 and U.S. Patent Application Publication No. 2015/0332880. However, each of these types of vacuum interrupters operate by linearly pushing contacts together or pulling contacts apart within the vacuum interrupter.

There remains room for improvement in switching elements in circuit interrupters employing vacuum interrupters.

SUMMARY

These needs and others are met by embodiments of the disclosed concept in which a rotary switch includes a rotary element that rotates between an open state and a closed state.

In accordance with one aspect of the disclosed concept, a rotary switch comprises: a housing having an interior and an exterior; a plurality of moving contacts entirely disposed within the interior of the housing; a plurality of stationary contacts disposed partially within the interior of the housing and extending to an exterior of the housing; and a rotary element coupled to the plurality of moving contacts and being structured to rotate between a closed state where at least one of the plurality moving contacts contact a corresponding one of the plurality of stationary contacts and an open state where the plurality of moving contacts and the plurality of stationary contacts are separated.

In accordance with another aspect of the disclosed concept, a circuit breaker structured to electrically couple between a power source and a load comprises: a number of rotary switches structured to electrically coupled between the power source and the load, each of the number of rotary switches comprising: a housing having an interior and an exterior; a plurality of moving contacts entirely disposed within the interior of the housing; a plurality of stationary contacts disposed partially within the interior of the housing and extending to an exterior of the housing; and a rotary element coupled to the plurality of moving contacts and being structured to rotate between a closed state where at least one of the plurality moving contacts contact a corresponding one of the plurality of stationary contacts and an open state where the plurality of moving contacts and the plurality of stationary contacts are separated; and control elements structured to control the rotary element to change between the closed state and the open state.

In accordance with another aspect of the disclosed concept, a rotary switch comprises: a plurality of first contacts; a plurality of second contacts; a rotary element coupled to the plurality of first contacts and being structured to rotate between a closed state where at least one of the plurality first contacts contact a corresponding one of the plurality of second contacts and an open state where the plurality of first contacts and the plurality of second contacts are separated; and a number of latching elements structured to latch the rotary element in the open state or the closed state.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1B:
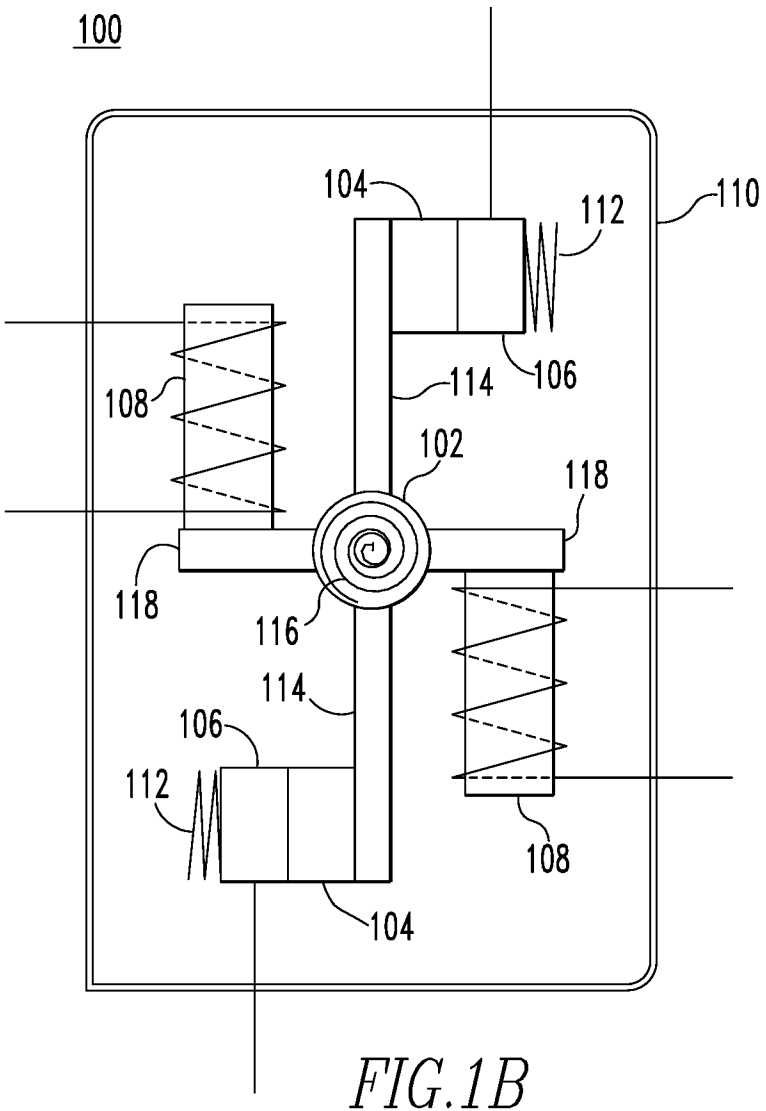
FIG. 1B is a schematic diagram of the rotary switch of FIG. 1A in the closed state in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

Figure 1A:
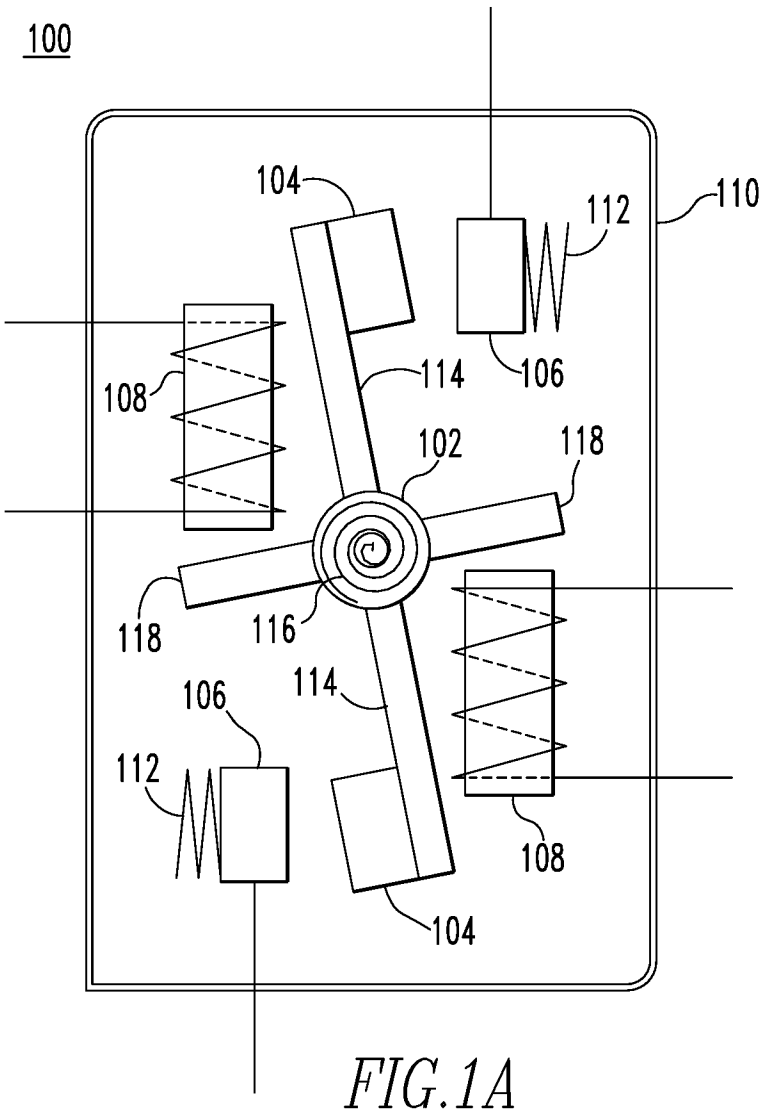
FIG. 1A is a schematic diagram of a rotary switch in the open state in accordance with an example embodiment of the disclosed concept.

FIG. 1A is a schematic diagram of a rotary switch 100 in an open state in accordance with an example embodiment of the disclosed concept and FIG. 1B is a schematic diagram of the rotary switch 100 in the closed state.

The rotary switch 100 includes a rotary element 102, moving contacts 104, and stationary contacts 106. The rotary switch 100 also includes a housing 110. The moving contacts 104 are entirely disposed within the housing 110. The stationary contacts 106 are disposed at least partially within the housing 110. In some example embodiments, the stationary contacts 106 extend from an interior to an exterior of the housing 110, while in some embodiments the stationary contacts 106 are coupled to one or more conductors that extend from the stationary contacts 106, respectively, to an exterior of the housing 110. The moving contacts 104 are located inside the housing 110.

A conductive element 114 electrically couples the moving contacts 104 with each other. That is, current can flow from one moving contact 104 to the other moving contact 104 via the conductive element 114.

The rotary element 102 is coupled to the moving contacts 104, for example via the conductive element 114, and is structured to rotate such that the moving contacts 104 move in conjunction with the rotation of the rotary element 102. The rotary element 102 is structured to rotate between an open state where the moving contacts 104 are separated from corresponding stationary contacts 106 (shown in FIG. 1A) and a closed state where the moving contacts 104 abut against and are in direct contact with their corresponding stationary contacts 106 (shown in FIG. 1B).

In some example embodiments, the rotary element 102 includes a return spring 116 such as a helix spring, for example. The spring 116 is structured to bias the rotary element 102 toward one of the open and closed states. In the example shown in FIGS. 1A and 1B, the spring 116 is structured to bias the rotary element 102 toward the open state. In some example embodiments, the rotary element 102 includes a motor. The motor may be controlled to rotate between the open and closed states.

The rotary switch 100 may also include a number of solenoids 108. The solenoids 108 may be employed to latch the rotary element 102 in the closed position. For example, the solenoids 108 may be activated by passing a current through their coils. The solenoids 108 may cooperate with armatures 118 coupled to the rotary element 102. By way of example, activating the solenoids 108 may attract the armatures 118 coupled to the rotary element 102, thus biasing and latching the rotary element 102 in the closed state shown in FIG. 1B. The solenoids 108 may be employed in example embodiments employing the helix spring 116, a motor, or both. It is also contemplated that the solenoids 108 may be omitted in some example embodiments. By latching the rotary element 102 in the closed position, the solenoids 108 counteract electrical forces that tend to push the moving and stationary contacts 104,106 apart. In some example embodiments of the disclosed concept, the conductive element 114 and the armatures 118 extends in axial directions away from the rotary element 102. For example, the conductive element 114 may extend in directions that are substantially perpendicular with respect to the direction that the armatures 118 extend, as is shown in FIGS. 1A and 1B. However, it will be appreciated that other arrangements may be employed without departing from the scope of the disclosed concept.

In some example embodiments of the disclosed concept, springs 112 are coupled to the stationary contacts 106 and are structured to bias the stationary contacts 106 toward the moving contacts 104. the springs 112 help to increase the contact force between the moving and stationary contacts 104,106, and to counteract electrical forces that tend to push the moving and stationary contacts 104,106 apart.

The housing 110 has an interior and an exterior. The moving contacts 104 and disposed entirely within the interior of the housing 110. The rotary element 102 is also disposed within the housing 110. The stationary contacts 106 are at least partially disposed within the interior of the housing. The stationary contacts 106, in some example embodiments, extend from an interior to an exterior of the housing 110, and, in some example embodiments, one or more conductors electrically connect to the stationary contacts 106 and extend to the exterior of the housing 110. External elements may be electrically coupled to the stationary contacts 106. When the rotary element 102 is in the closed state, current is conducted between the stationary contacts 106 and, when the rotary element 102 is in the open state, current is unable to conduct between the stationary contacts 106. In some example embodiments of the disclosed concept, the interior of the housing 110 is a vacuum. Seals may be employed to maintain the vacuum where components extend from an interior to an exterior of the housing 110 such as the stationary contacts 106 and any conductors need to control the rotary element 102 and/or the solenoids 108.

Figure 2A:
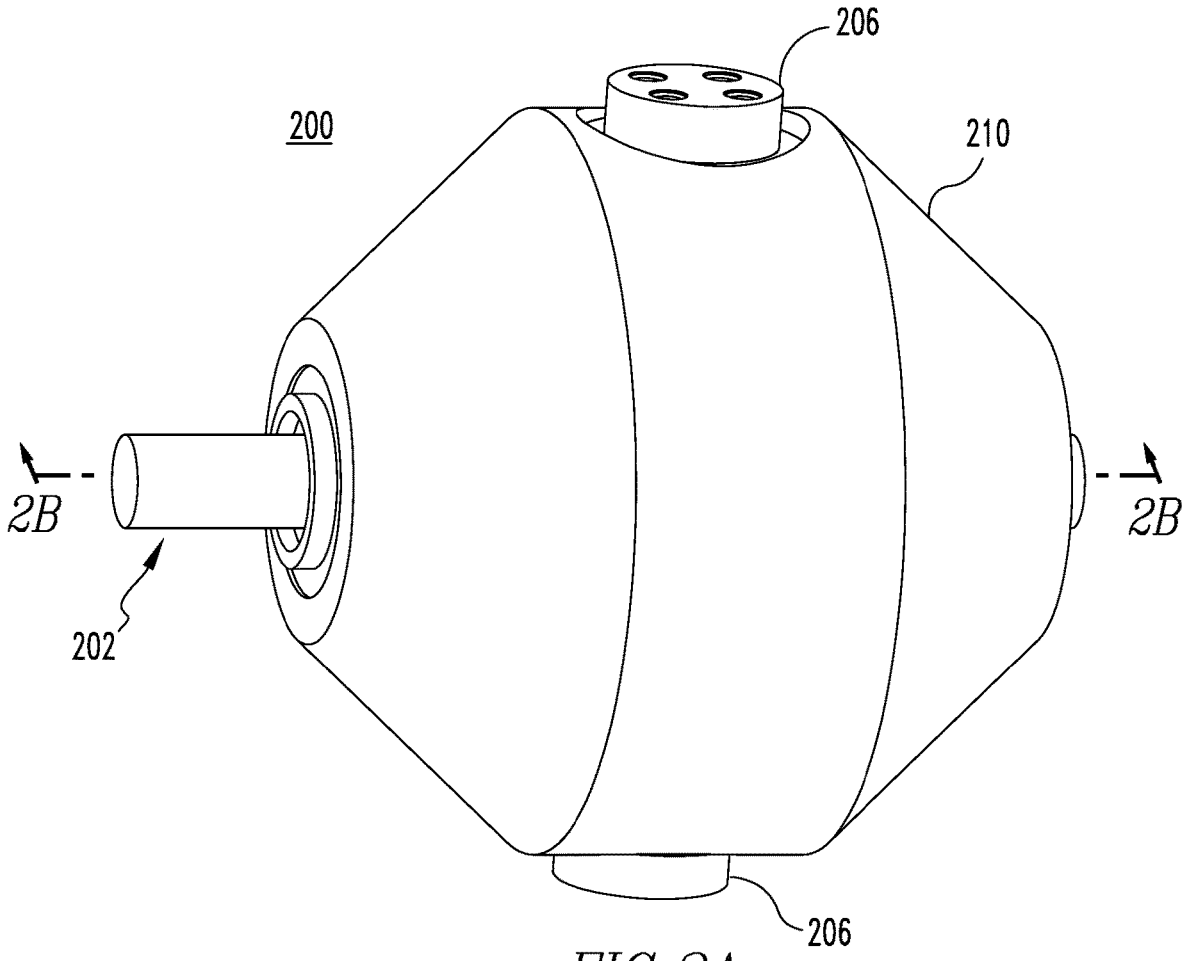
FIG. 2A is an external view of a rotary switch in accordance with an example embodiment of the disclosed concept.
Figure 2B:
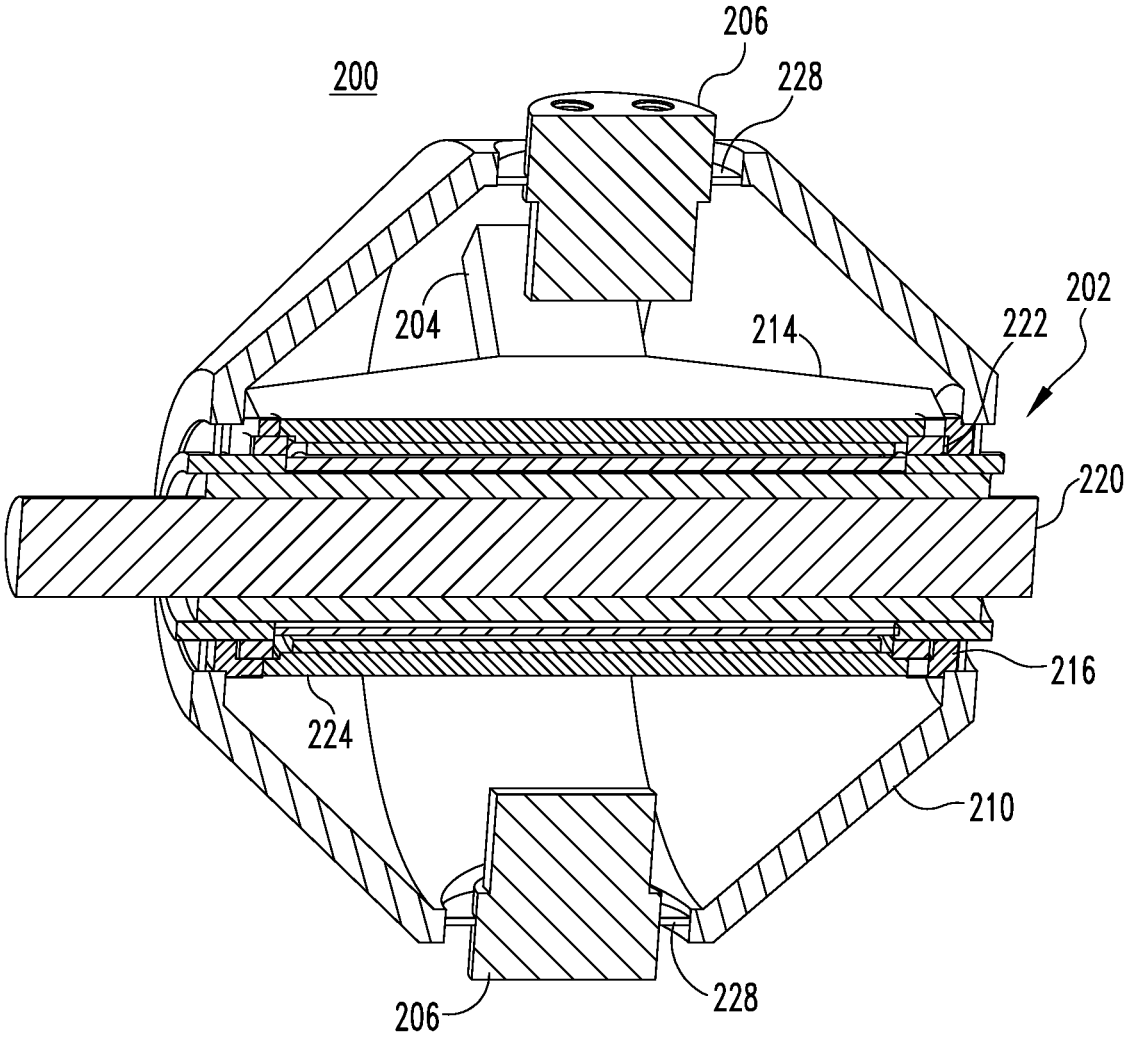
FIG. 2B is a section view of the rotary switch of FIG. 2A in accordance with an example embodiment of the disclosed concept.
Figure 2C:
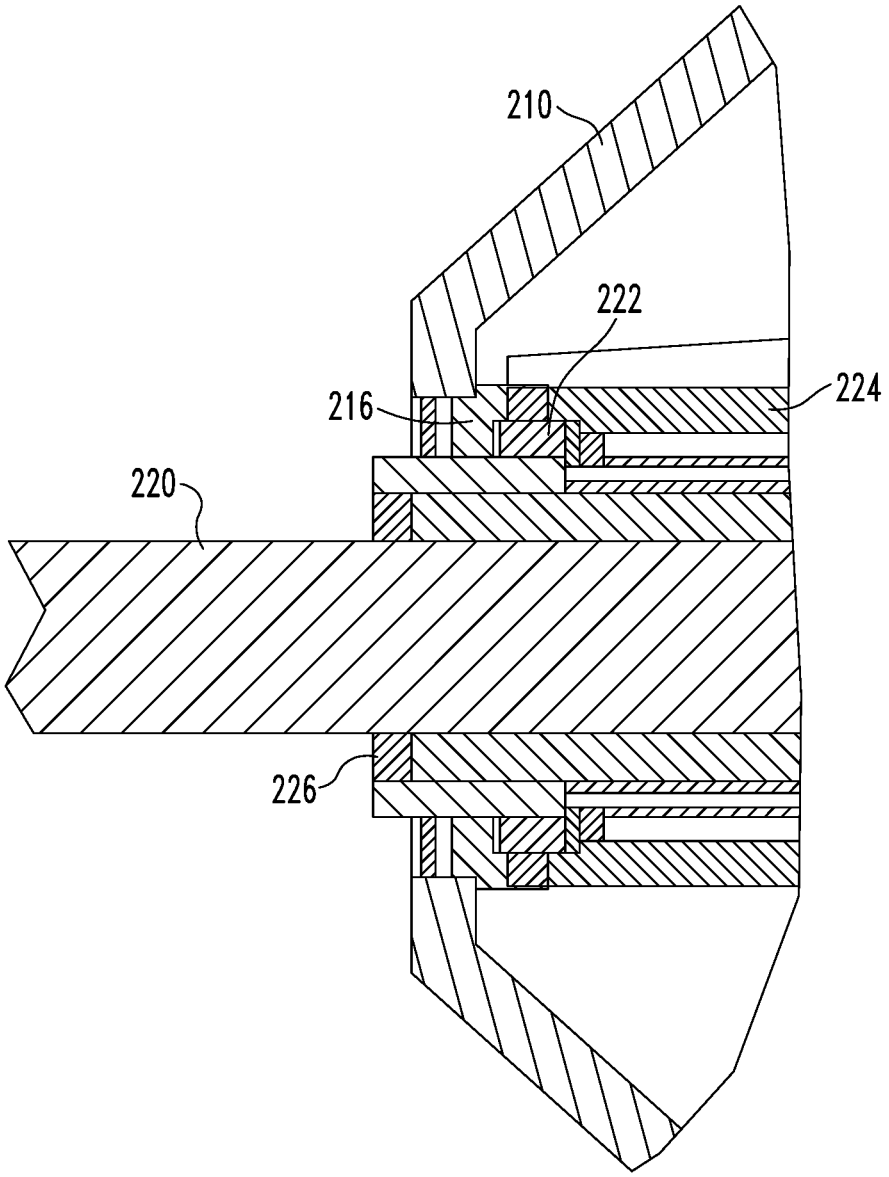
FIG. 2C is a more detailed view of the section view of FIG. 2B in accordance with an example embodiment of the disclosed concept.

FIG. 2A is an external view of a rotary switch 200 in accordance with another example embodiment of the disclosed concept. FIG. 2B is section view of the rotary switch 200 of FIG. 2A and FIG. 2C shows the section view of FIG. 2B in more detail. The rotary switch 200 includes a housing 210, a rotary element 202, two moving contacts 204 (only one of the moving contacts 204 is shown in FIG. 2B), and two stationary contacts 206. The rotary element 202 is structured to rotate between a closed state where the two moving contacts 204 contact their corresponding stationary contacts 206 creating a conductive path between the stationary contacts 206, and an open state where the two moving contacts 204 are spaced from their corresponding stationary contacts 206 breaking the conductive path between the stationary contacts 206.

The moving contacts 204 are disposed within the housing 210 and are electrically coupled to each other by a conductive element 214. The conductive element 214 may be disposed around the rotary element 202 and may have a roughly cylindrical shape. The stationary contacts 206 are disposed partially within the housing 210 and extend to an exterior of the housing 210.

The rotary element 202 in the example embodiment shown in FIGS. 2A-C may be a motor such as, for example and without limitation, a brushless DC motor or other suitable type of motor. A brushless DC motor provides high torque at low speed, is efficient, and causes minimal noise. For example, the rotary element 202 may include a stator assembly 220, a rotor assembly 224, and a bearing assembly 216. The rotary element 202 may also include a spring 216. The stator assembly 220 may have a substantially cylindrical shape and the rotor assembly 224 may be disposed around the stator assembly 220. Driving the rotary element 202, such as by applying a current to the rotary element 202, causes the rotor assembly 224 to rotate about the stator assembly 220. The conductive element 214 is coupled to the rotor assembly 224 such that the conductive element 214 rotates in conjunction with rotation of the rotor assembly 224. Rotating the rotary element 202 (i.e., rotating the rotor assembly 224) causes the conductive element 214 and the moving contacts 204 to rotate between the open state and the closed state. The spring 216 is coupled to the rotor assembly 224 and is structured to bias the rotary element 202 towards the closed state. The bias of the spring 216 assists in maintaining the rotary element 202 in the close state, as electrical effects of current flowing between the moving and stationary contacts 204,206 may tend to push the moving and stationary contacts 204,206 away from each other. The spring 216 may be, for example and without limitation, a torsion spring. The bearing assembly 222 is disposed between the stator assembly 220 and the rotor assembly 224 and is structured to reduce friction during rotation of the rotor assembly 224.

In the example embodiment shown in FIGS. 2A-C, the housing 210 has a tapered cylindrical shape. That is, a central portion of the housing 210 has a cylindrical shape with a first radius that tapers down in radius to a smaller second radius at each end portion of the housing 210. The stationary contacts 206 are disposed at the central portion of the housing 210 and the stator assembly 220 extends from one end portion to the other end portion of the housing 210. In some example embodiments of the disclosed concept, the housing 210 may be vacuum sealed such that an interior of the housing 210 is a vacuum. To facilitate vacuum sealing, the rotary switch 200 may include sealing elements 226,228 disposed around openings where elements, such as the stationary contacts 206 and stator assembly 220 penetrate the housing 210.

In some example embodiments of the disclosed concept, the rotary switch 200 may have a length (i.e. from one end portion where the stator assembly 220 penetrates the housing 210 to the other end portion where the stator assembly 220 penetrates the housing 210) of approximately 10 inches and a maximum diameter (i.e., a distance from where one stationary contact 206 penetrates the housing 210 to where the other stationary contact 206 penetrates the housing 210) of approximately 10 inches. The size of the rotary switch 200, and in particular, the length of the rotary switch 200, is smaller than the length of the vacuum interrupters used in the indoor switching module type LD manufactured by Tavrida Electric. The increased length of the vacuum interrupters used in the indoor switching module type LD manufactured by Tavrida Electric is due to them using a linear switch that is external to the vacuum chamber. The rotary switch 200 in the example embodiment shown in FIGS. 2A-C, and rotary switches described in other example embodiments of the disclosed concept, uses rotary motion, rather than linear motion, to facilitate switching that is internal to the vacuum chamber.

Figure 3A:
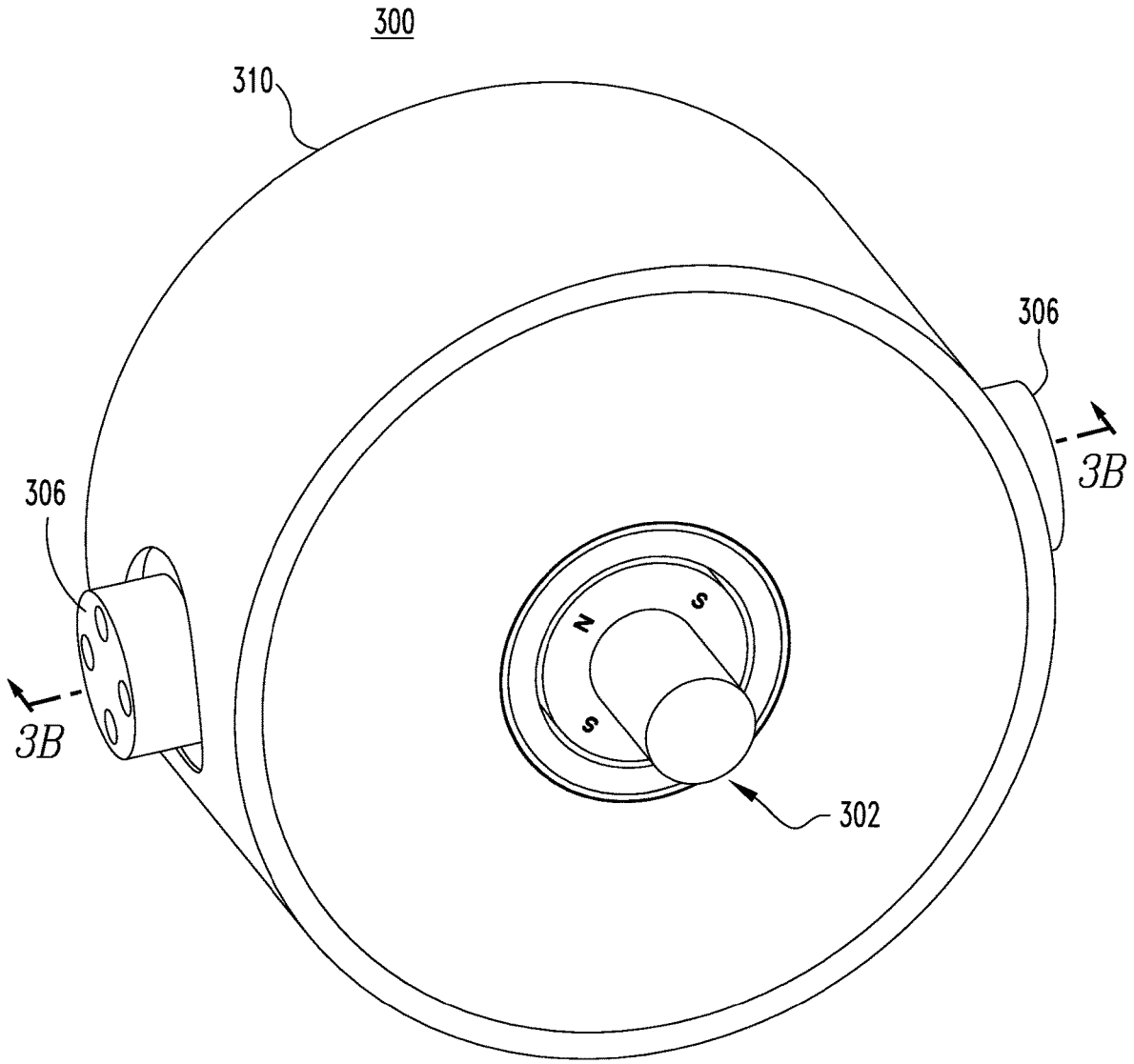
FIG. 3A is an external view of a rotary switch in accordance with an example embodiment of the disclosed concept.
Figure 3B:
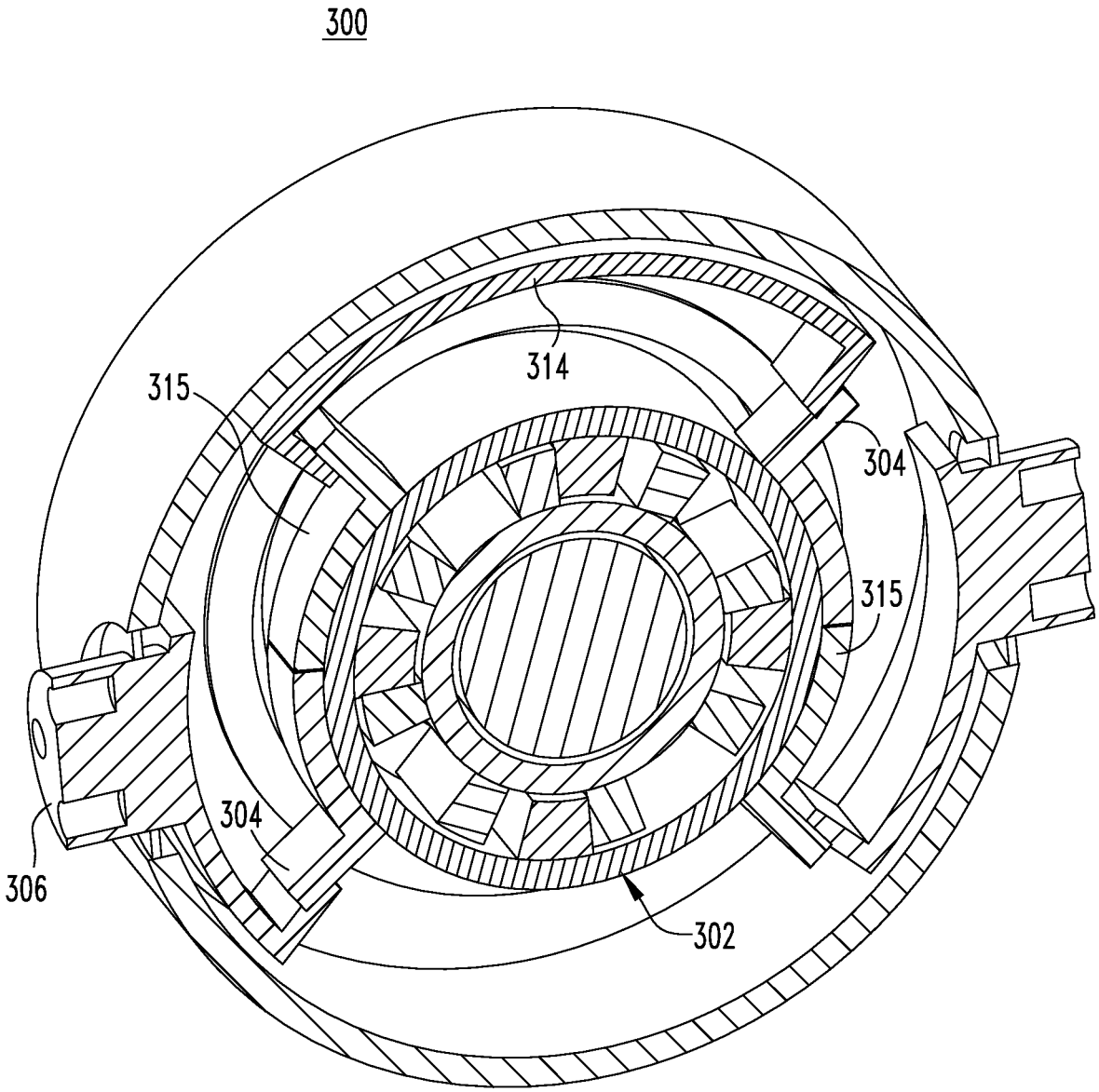
FIG. 3B is a section view of the rotary switch of FIG. 3A in the open state in accordance with an example embodiment of the disclosed concept.
Figure 3C:
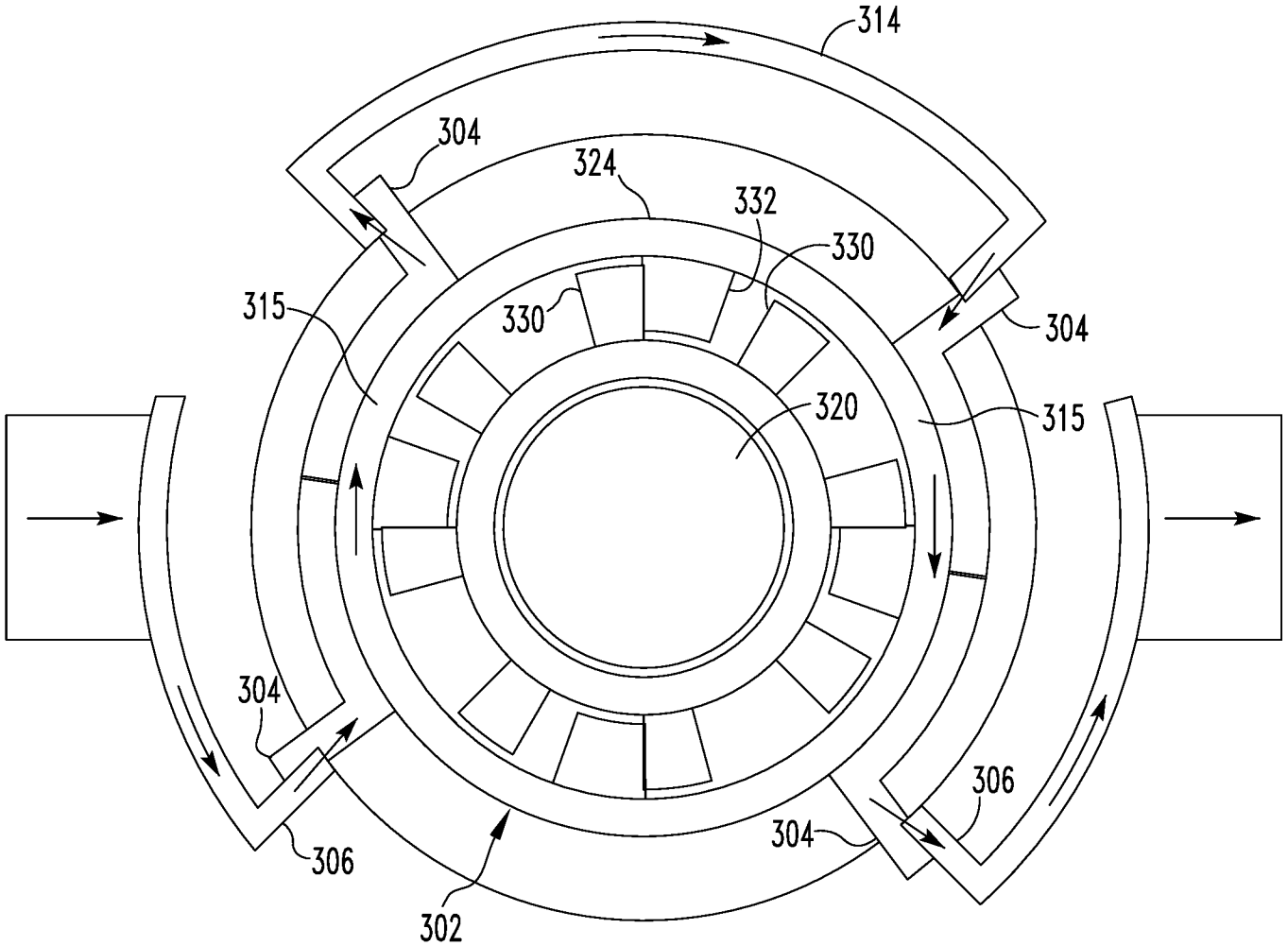
FIG. 3C is a section view of the rotary switch of FIG. 3A in the closed state in accordance with an example embodiment of the disclosed concept.

FIG. 3A is an external view of a rotary switch 300 in accordance with another example embodiment of the disclosed concept. FIG. 3B is an isometric section view of the rotary switch 300 of FIG. 3A in an open state and FIG. 3C is a side section view of the rotary switch 300 of FIG. 3A in a closed state. The rotary switch 300 includes a housing 310, a rotary element 302, moving contacts 304, and stationary contacts 306. The rotary switch 300 also includes a first conductive element 314 and a two second conductive elements 315.

The rotary switch 300 includes four moving contacts 304 and two stationary contacts 306. The moving contacts 304 are disposed within the interior of the housing 310 and the stationary contacts 306 are partially disposed within the interior of the housing 310 and extend to an exterior of the housing 310. When the rotary switch 310 is in the closed state, two of the moving contacts 304 contact their corresponding stationary contacts 306 and two of the moving contacts 304 contact the first conductive element 314, as is shown in FIG. 3C. The second conductive elements 315 each electrically couple two of the moving contacts 304. When the rotary switch 310 is in the open state, as is shown in FIG. 3B, the moving contacts 304 are separated from the stationary contacts 306 and the first conductive element 314.

Using four moving contacts 304 instead of two moving contacts shown in other example embodiments of the disclosed concept, can reduce the travel distance of the moving contacts 304 when moving from the open state to the closed state. In some example embodiments of the disclosed concept, the travel distance of the moving contacts 304 between the open state and the closed state is approximately 0.25 inches. The reduced travel distance allows a faster transition between the open state and the closed state compared with switches whose contacts have a greater travel distance. Additionally, when the rotary switch 300 is in the closed state and current is flowing between the stationary contacts 306 via the moving contacts 304 and the first and second conductive elements 314,315, magnetic forces created by the current increases the contact force between the moving and stationary contacts 304,306.

The rotary element 302 includes a stator assembly 320 and a rotor assembly 324. The rotor assembly 324 is structured to rotate about the stator assembly 324. Rotation of the rotor assembly 324 may be caused, for example, by applying current to the rotary element 302. The rotor assembly 324 is coupled to the second conductive elements 315 and the moving contacts 304 such that the second conductive elements 315 and the moving contacts 304 rotate in conjunction with the rotor assembly 324. Thus, rotating the rotary element 302 (i.e., rotating the rotor assembly 324) causes the moving contacts 304 to move between the open state (shown in FIG. 3B) and the closed state (shown in FIG. 3C).

The rotary element 302 also includes a plurality of fixed magnets 330 and a plurality of moving magnets 332. The fixed magnets 330 are coupled to the stator assembly 330 and do not move when the rotor assembly 324 is rotated. The moving magnets 332 are coupled to the rotor assembly 324 such that they rotate in conjunction with the rotor assembly 324. Each moving magnet 332 corresponds to a pair of the fixed magnets 330. When the rotary switch 300 is in the open state, each moving magnet 332 contacts one of its corresponding pair of fixed magnets 330. When the rotary switch 300 is in the closed state, each moving magnet 332 contact the other of its corresponding pair of fixed magnets 330. The magnetic force of the fixed and moving magnets 330,332 creates a force that resists pulling the fixed and moving magnets 330,332 apart when they contact each other. Thus, when in the closed state, the magnetic force between the fixed and moving magnets 330,332 resist the rotary switch 300 moving to the open state and, when in the open state, the magnetic force between the fixed and moving magnets 330,332 resist the rotary switch 300 moving to the closed state, thus latching the rotary switch 300 in its current state and preventing an unintended change in state. Activating the rotary element 302 by applying power and causing the rotor assembly 324 to rotate overcomes the magnetic force and causes the rotary switch 300 to change its state.

The rotary element 302 may have a substantially cylindrical shape in some example embodiments. The second conductive elements 315 may have a curved shape that conforms to the circumference of the rotary element 302 and abuts against the rotary element 302. The moving contacts 304 may extend in a direction away from the rotary element 302. The first conductive element 314 may have a central portion that conforms to an interior shape of the housing 310 and end portions that extend toward a central area of the housing 310. The end portions of the first conductive element 314 are structured to contact two of the moving contacts 304 when the rotary switch 300 is in the closed state. The stationary contacts 306 may each have a contacting portion that is disposed within the interior of the housing 310 and are structured to contact a corresponding moving contact 304 when the rotary switch 300 is in the closed state. The stationary contacts 306 may each also have a coupling portion coupled to the contacting portion that proceeds to and through an opening in the housing 310 to an exterior of the housing 310 and allowing coupling to components external to the housing 310.

The housing 310 may have a substantially cylindrical shape, as shown in FIG. 3A for example. In some example embodiments, the housing 310 may have a diameter of about 7.5 inches and a length (i.e., a distance from where the stator assembly 320 enters the housing 310 to where the stator assembly 320 exits the housing 310) of about 4 inches. In some example embodiments, the housing 310 may be vacuum sealed such that the interior of the housing 310 is a vacuum. Sealing elements, similar to those described with respect to FIGS. 2A-C may be employed to seal any openings in the housing 310.

Rotary switches in accordance with example embodiments of the disclosed concept may be employed in various applications. For example, FIGS. 4A and 4B are partially schematic diagrams of the rotary switch 200 employed in a circuit breaker in accordance with an example embodiment of the disclosed concept and FIG. 5 is a partially schematic diagram of the rotary switch 200 employed in a hybrid breaker in accordance with an example embodiment of the disclosed concept.

Figure 4A:
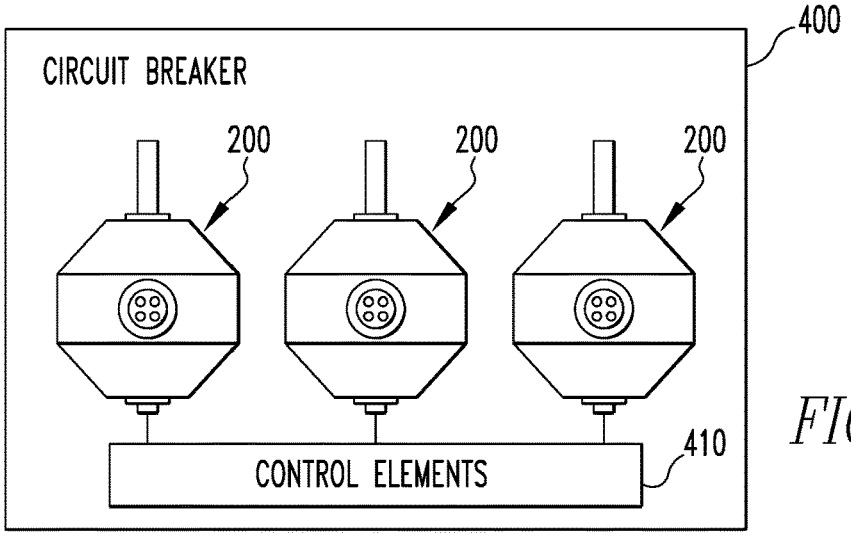
FIG. 4A is a partial schematic front view of a circuit breaker in accordance with an example embodiment of the disclosed concept.
Figure 4B:
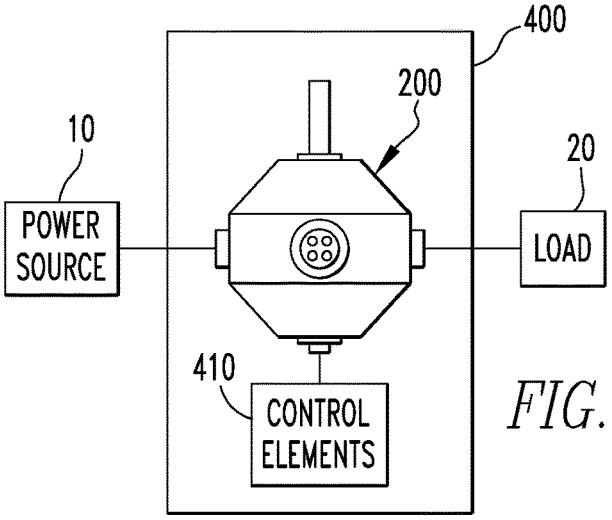
FIG. 4B is a partial schematic side view of the circuit breaker of FIG. 4A in accordance with an example embodiment of the disclosed concept.

Referring to FIGS. 4A and 4B, a circuit breaker 400 includes control elements 410 and three rotary switches 200 and is structured to be electrically coupled between one or more power sources 10 and one or more loads 20. In the example embodiment shown in FIGS. 4A-B, the circuit breaker 400 is a 3-pole breaker including three rotary switches 200. However, it will be appreciated that any number of poles (e.g., single pole, etc.) may be employed without departing from the scope of the disclosed concept. The control elements 410 include circuitry for controlling the rotary switches 200 (i.e., circuitry to provide power to rotate the rotary switches between the open and closed states). As shown in FIG. 4B, the stationary contacts of the rotary switch 200 are connected to the power source 10 and the load 20, respectively. Thus, when there is a fault condition, for example, the control elements 410 may cause the rotary switch 200 to rotate to the open state and disconnect the power source 10 from the load 20. Using the rotary switch 200 instead of other vacuum interrupters that use linear switching can reduce the overall size of the circuit breaker 400. While the rotary switch 200 is described in connection with the circuit breaker 400, it will be appreciated that rotary switches in accordance with any embodiment of the disclosed concept may be employed in the circuit breaker 400.

Figure 5:
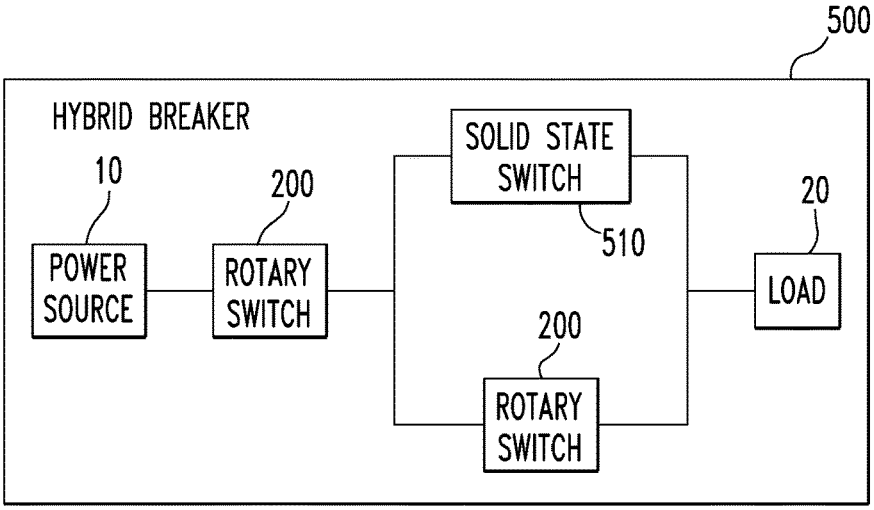
FIG. 5 is a schematic view of a hybrid breaker in accordance with an example embodiment of the disclosed concept.

Referring to FIG. 5, a hybrid breaker 500 is connected between a power source 10 and a load 20. The hybrid breaker 500 includes rotary switches 200 and a solid state switch 510. Hybrid breakers 500 include both a mechanical switch, such as the rotary switches 200, and a solid state switch 510. The solid state switch 510 is electrically connected in parallel with one of the rotary switches 200. In the case of a fault or other event which merits the hybrid breaker 500 opening, the rotary switch 200 connected in parallel with the solid state switch 510 is opened first. Current is commutated through the solid state switch 510 for a period of time and then the solid state switch 510 is opened. Subsequently, the rotary switch 200 connected in series with the parallel combination of the solid state switch 510 and the rotary switch 200 is opened. In hybrid breakers 500 it is beneficial for the mechanical switch electrically connected in parallel with the solid state switch 510 to be able to transition from closed to open very fast. The rotary switch 200 can open faster than conventional mechanical switches and, thus, provides an improvement to the hybrid breaker 500. Using the rotary switch 200 as both mechanical switches in the hybrid breaker 500 can also reduce the overall size of the hybrid breaker 500. While the rotary switch 200 is described in connection with the hybrid breaker 500, it will be appreciated that rotary switches in accordance with any embodiment of the disclosed concept may be employed in the hybrid breaker 500.

It will be appreciated that elements from the various embodiments described herein may be employed in other embodiments without departing from the scope of the disclosed concept. For example and without limitation, using solenoids 108 for latching, as is done in the rotary switch 100 shown in FIGS. 1A-B, may be employed in other embodiments without departing from the scope of the disclosed concept. Similarly, using more than two moving contacts, as is done in the rotary switch 300 shown in FIGS. 3A-C, may be employed in other embodiments without departing from the scope of the disclosed concept. The disclosed embodiments should be understood as examples and it will be understood that elements from one embodiment may be added to or used as substitution for elements in other embodiments without departing from the scope of the disclosed concept.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A rotary switch comprising:

a housing having an interior and an exterior;

a plurality of moving contacts entirely disposed within the interior of the housing;

a plurality of stationary contacts disposed partially within the interior of the housing and extending to an exterior of the housing; and a rotary element comprising a cylindrical shaft, the rotary element being coupled to the plurality of moving contacts and being structured to rotate between a closed state where at least one of the plurality of moving contacts contact a corresponding one of the plurality of stationary contacts and an open state where the plurality of moving contacts and the plurality of stationary contacts are separated, wherein the rotary element is structured such that, in order for the rotary element to rotate between the closed state and the open state, current must flow concentrically around an axis of the shaft.

2. The rotary switch of claim 1, further comprising:

a conductive element structured to electrically couple a first one of the plurality of moving contacts to a second one of the plurality of moving contacts.

3. The rotary switch of claim 1, further comprising:

a first conductive element structured to electrically couple a first one of the plurality of moving contacts to a second one of the plurality of moving contacts when the rotary element is in the closed state; and a number of second conductive elements each structured to electrically couple two of the plurality of moving contacts when the rotary element is in the closed state and when the rotary element is in the open state.

4. The rotary switch of claim 1, wherein the rotary element includes a stator assembly and a rotor assembly structured to rotate about the stator assembly; and wherein the plurality of moving contacts are coupled to the rotor assembly such that the plurality of moving contacts rotate in conjunction with rotation of the rotor assembly.

5. The rotary switch of claim 4, wherein the rotary element includes a spring structured to bias the rotor assembly to one of the closed state and the open state.

6. The rotary switch of claim 4, further comprising a bearing assembly disposed between the stator assembly and the rotor assembly and being structured to reduce friction when the rotor assembly rotates.

7. The rotary switch of claim 1, wherein the rotary element includes a spring structured to bias the rotary element to one of the closed state and the open state.

8. The rotary switch of claim 7, further comprising:

a number of solenoids structured to interact with the rotary element such that the number of solenoids latch the rotary element in the closed state when activated.

9. The rotary switch of claim 1, wherein the rotary element includes a moving magnet and a pair of fixed magnets; wherein the moving magnet is coupled to the rotary assembly such that the moving magnet rotates in conjunction with rotation of the rotary element; wherein the moving magnet is structured to contact one of the pair of fixed magnets when the rotary element is in the closed state and to contact the other of the pair of fixed magnets when the rotary element is in the open state.

10. The rotary switch of claim 1, wherein the plurality of moving contacts is two moving contacts and the plurality of stationary contacts is two stationary contacts.

11. The rotary switch of claim 1, wherein the plurality of moving contacts is four moving contacts and the plurality of stationary contacts is two stationary contacts.

12. The rotary switch of claim 1, wherein the housing is vacuum sealed such that the interior of the housing is in vacuum.

13. The rotary switch of claim 12, further comprising:

a plurality of seals, each disposed at a corresponding opening of the housing and structured to seal the interior of the housing from the exterior of the housing.

14. The rotary switch of claim 1, wherein the housing has a substantially cylindrical shape.

15. The rotary switch of claim 1, wherein the housing has a tapered cylindrical shape such that a central portion of the housing has a greater diameter than end portions of the housing.

16. A circuit breaker structured to electrically couple between a power source and a load, the circuit breaker comprising:

a number of rotary switches structured to electrically coupled between the power source and the load, each of the number of rotary switches comprising:

a housing having an interior and an exterior;

a plurality of moving contacts entirely disposed within the interior of the housing;

a plurality of stationary contacts disposed partially within the interior of the housing and extending to an exterior of the housing; and a rotary element comprising a cylindrical shaft, the rotary element being coupled to the plurality of interior contacts and being structured to rotate between a closed state where at least one of the plurality of moving contacts contact a corresponding one of the plurality of stationary contacts and an open state where the plurality of moving contacts and the plurality of stationary contacts are separated; and control elements structured to control the rotary element to change between the closed state and the open state, wherein, for each of the number of rotary switches, with respect to a plane in which the entire shaft axis lies and which bifurcates the shaft, the rotary element is symmetric with respect to the plane.

17. The circuit breaker of claim 16, further comprising:

a solid state switch electrically connected in parallel with a first of the number of rotary switches.

18. The circuit breaker of claim 17, wherein a second of the number of rotary switches is electrically connected in series with a parallel combination of the first of the number of rotary switches and the solid state switch.

19. A rotary switch comprising:

a plurality of first contacts;

a plurality of second contacts;

a rotary element comprising a cylindrical shaft, the rotary element being coupled to the plurality of first contacts and being structured to rotate between a closed state where at least one of the plurality first contacts contact a corresponding one of the plurality of second contacts and an open state where the plurality of first contacts and the plurality of second contacts are separated; and a number of latching elements structured to latch the rotary element in the open state or the closed state, wherein the rotary element is structured such that, in order for the rotary element to rotate between the closed state and the open state, current must flow concentrically around an axis of the shaft.

20. The rotary switch of claim 19, wherein the number of latching elements includes at least one of a spring, a solenoid, and a magnet.

* * * * *